US012607088B1

(12) United States Patent
Keilers et al.

(10) Patent No.: US 12,607,088 B1
(45) Date of Patent: Apr. 21, 2026

(54) SYSTEMS AND METHODS FOR CONTROLLED PACKER INFLATION

(71) Applicant: Schlumberger Technology Corporation, Sugar Land, TX (US)

(72) Inventors: Adam Ethan Keilers, Richmond, TX (US); Mark Hofacker, Sugar Land, TX (US); Mark Callister Oettli, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 19/210,522

(22) Filed: May 16, 2025

(51) Int. Cl.
*E21B 33/127* (2006.01)
*E21B 47/10* (2012.01)

(52) U.S. Cl.
CPC ..... *E21B 33/1275* (2013.01); *E21B 47/10* (2013.01)

(58) Field of Classification Search
CPC ..... E21B 33/1243; E21B 33/1275; E21B 33/1285
See application file for complete search history.

(56) References Cited

U.S. PATENT DOCUMENTS 2,511,759 A * 6/1950 Williams ..... E21B 49/082 166/66.4
2,842,210 A * 7/1958 Ramsey ..... E21B 49/10 166/100
2,859,828 A * 11/1958 Williams ..... E21B 49/081 166/107
4,729,430 A * 3/1988 White ..... E21B 33/1246 166/106
4,877,086 A * 10/1989 Zunkel ..... E21B 33/1246 166/321
5,097,902 A * 3/1992 Clark ..... F04C 13/008 418/48
5,271,461 A * 12/1993 Decker ..... E21B 34/102 166/185
6,834,727 B2 * 12/2004 Wills ..... E21B 33/127 166/387
7,025,146 B2 * 4/2006 King ..... E21B 33/1285 166/376
7,322,422 B2 * 1/2008 Patel ..... E21B 33/127 166/278
7,753,129 B2 * 7/2010 Head ..... F04B 47/06 166/387
7,762,325 B2 * 7/2010 Ellson ..... E21B 33/1285 166/187
8,479,832 B2 * 7/2013 Tunc ..... E21B 33/127 166/387
9,695,667 B2 * 7/2017 Sears ..... E21B 43/128
9,803,465 B2 * 10/2017 Hallundbæk ..... E21B 47/06
(Continued)

FOREIGN PATENT DOCUMENTS

CN 103930645 A * 7/2014 ..... E21B 33/1243
GB 2555637 A * 5/2018 ..... E21B 47/117
(Continued)

*Primary Examiner* — Jennifer H Gay
(74) *Attorney, Agent, or Firm* — Jeffrey D. Frantz

(57) ABSTRACT

A downhole tool may pump an inflation fluid with a mud pump located in a downhole environment. A downhole tool may direct the inflation fluid into an inflatable packer local to the mud pump in the downhole environment. A downhole tool may inflate the inflatable packer in the downhole environment.

20 Claims, 4 Drawing Sheets

(56) References Cited

U.S. PATENT DOCUMENTS 10,648,273 B2 * 5/2020 Krieg ..... E21B 33/1275
11,851,974 B1 * 12/2023 Ejim ..... E21B 33/1243
12,037,858 B2 * 7/2024 Hallundbæk ..... F04B 53/16
12,098,612 B2 * 9/2024 Cochran ..... E21B 33/127
12,105,226 B2 * 10/2024 Schroit ..... G01S 17/931
12,215,550 B2 * 2/2025 Isted ..... E21B 41/00
12,241,332 B1 * 3/2025 Ball ..... E21B 33/1246
2003/0196820 A1 * 10/2003 Patel ..... E21B 33/127
166/387
2004/0129432 A1 * 7/2004 Wills ..... E21B 33/1243
166/387
2005/0023004 A1 * 2/2005 King ..... E21B 33/1294
166/387
2008/0196902 A1 * 8/2008 Head ..... F04B 47/06
166/66.4
2009/0025983 A1 * 1/2009 Ellson ..... E21B 33/1285
173/13
2010/0206571 A1 * 8/2010 Tunc ..... E21B 33/127
166/308.1
2014/0318770 A1 * 10/2014 Hallundbæk ..... E21B 47/06
166/250.12
2015/0068738 A1 * 3/2015 Wayne ..... E21B 47/06
166/250.11
2016/0061010 A1 * 3/2016 Sears ..... E21B 43/128
166/66.4
2018/0371895 A1 * 12/2018 Taal ..... E21B 47/06
2019/0100977 A1 * 4/2019 Corre ..... E21B 33/127
2019/0242210 A1 * 8/2019 Krieg ..... E21B 47/06
2022/0098946 A1 * 3/2022 Hallundbæk ..... F04B 17/03
2022/0259936 A1 * 8/2022 Schroit ..... G01S 17/86
2023/0407723 A1 * 12/2023 Cochran ..... E21B 23/06
2024/0376787 A1 * 11/2024 Isted ..... E21B 17/028
2025/0270892 A1 * 8/2025 Dave ..... E21B 23/0416

FOREIGN PATENT DOCUMENTS

WO WO-2019122835 A1 * 6/2019 ..... E21B 33/1275
WO WO-2020233864 A1 * 11/2020 ..... E21B 23/06
WO WO-2025183692 A1 * 9/2025 ..... E21B 34/14

* cited by examiner

SYSTEMS AND METHODS FOR CONTROLLED PACKER INFLATION

BACKGROUND OF THE DISCLOSURE

Exploring, drilling, and completing hydrocarbon and other wells are generally complicated, time consuming and ultimately very expensive endeavors. As such, tremendous emphasis is often placed on well applications and monitoring that rely heavily on periodic intervention for sake of well management. For example, various wireline (WL), tractoring, coiled tubing (CT) and other types of interventions are often periodically introduced to the well throughout the life of the well. These interventions may be aimed at acquiring well condition information, directing a well cleanout, installation of downhole devices or a variety of other applications.

By way of example, CT systems may operate based on lowering various components or downhole tools into a wellbore. To measure or test properties of a wellbore with the lowered components or downhole tools, a portion of the wellbore is isolated using an inflatable packer that expands against the walls of the wellbore and limits or prevents fluid flow across the packer.

SUMMARY

In some aspects, the techniques described herein relate to a method of controlling a downhole tool of a coiled tubing system, the method including: pumping an inflation fluid with a mud pump located in a downhole environment; directing the inflation fluid into an inflatable packer local to the mud pump in the downhole environment; and inflating the inflatable packer in the downhole environment.

In some aspects, the techniques described herein relate to a method of controlling a downhole tool, the method including: pumping an inflation fluid with a mud pump located in a downhole environment; directing the inflation fluid into an inflatable packer local to the mud pump in the downhole environment; partially inflating the inflatable packer in the downhole environment; measuring a cross-flow of wellbore fluid proximate to the inflatable packer; and adjusting a control of the mud pump based on the cross-flow.

In some aspects, the techniques described herein relate to a system, including: a derrick; a coiled tubing line partially positioned within a wellbore and being conveyed from a drum; a mud motor located at a terminal end of the coiled tubing line; and an inflatable packer in fluid communication with the mud motor and configured to receive an inflation fluid from the mud motor.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

This disclosure generally relates to systems and methods for controlling the operation of a coiled tubing (CT) system. More particularly, the present disclosure relates to the control of an inflatable packer of a CT system in a downhole environment. In some embodiments, the CT system includes an inflatable packer at a terminal end of the coiled tubing line in the downhole environment of a borehole (e.g., a wellbore). In some embodiments, the inflatable packer is deployed during drilling of the borehole to isolate a region of the formation in which the borehole is drilling for testing. In some embodiments, the inflatable packer is deployed during finishing of the borehole to isolate a region of the borehole for testing of the formation, a casing, a lining, or other borehole wall material. In some embodiments, the inflatable packer is deployed during production of the borehole to isolate a region of the borehole for testing of production or fluid composition. In some embodiments, the inflatable packer is deployed during production of the borehole to stimulate a region of the borehole via fluids. In at least one example, the inflatable packer is deployed to test or measure pressure or pressure differentials in the borehole.

Conventional packer inflation includes directing a flow of fluid through the coiled tubing to create a pressure differential at the inflatable packer and force the packer to expand against the wellbore wall. Such pressure differential-based inflation provides less precise control than at least some methods described herein and can result in damage to the packer. In some embodiments according to the present disclosure, a mud pump located proximate to the inflatable packer in the downhole environment can provide a more controlled inflation (and deflation) of the packer, which may limit and/or prevent damage to the packer.

Figure 1:
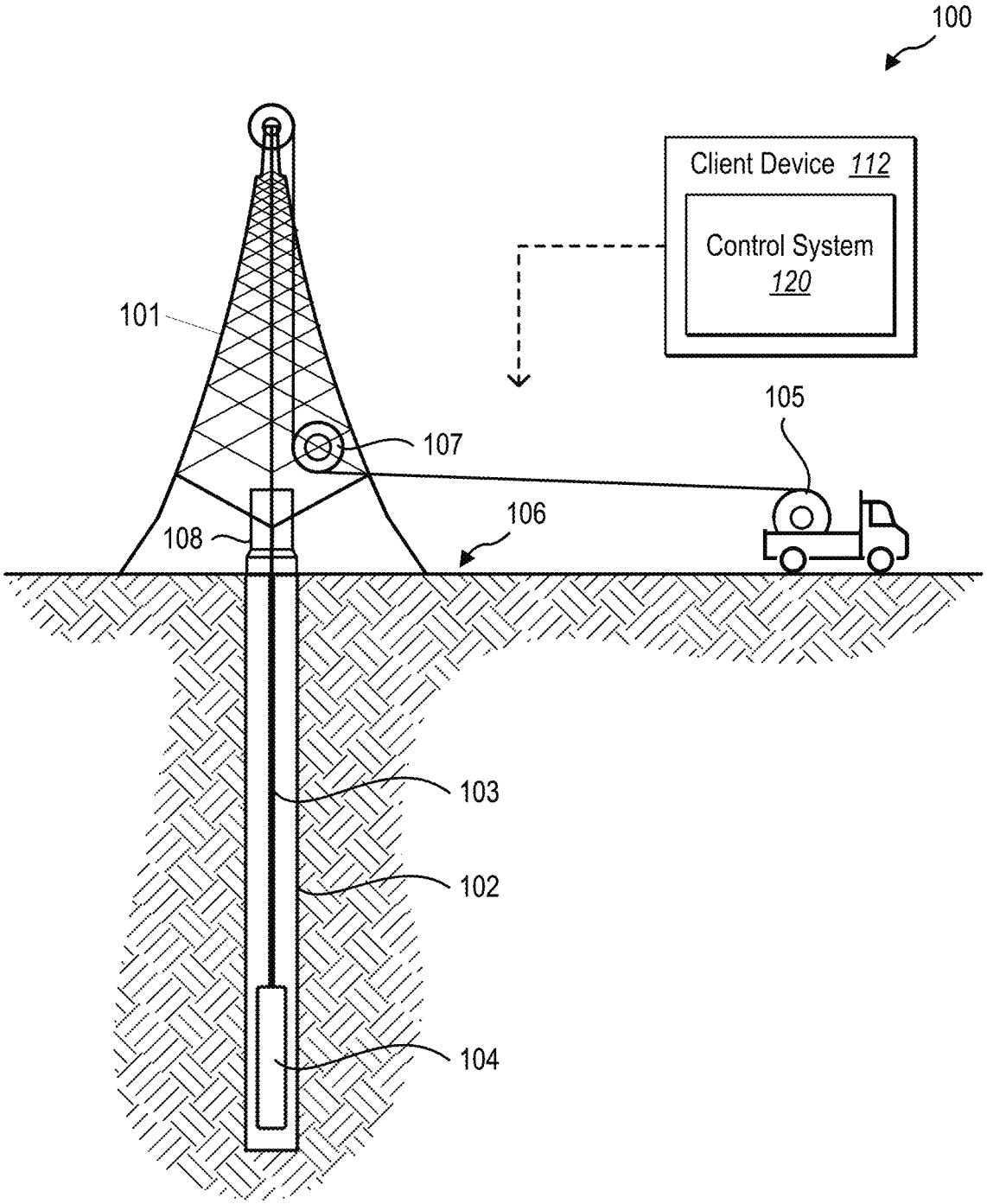
FIG. 1 is an example of a conveyance system, according to at least one embodiment of the present disclosure.

Additional details will now be provided regarding systems described herein in relation to illustrative figures portraying example implementations. For example, FIG. 1 shows one example of a conveyance system 100 for performing a conveyance operation within a wellbore 102. The conveyance system 100 includes a rig, mast, or derrick 101 used to support a conveyance line 103 (e.g., WL line or CT line) at a surface 106. The derrick 101 described herein is an illustrative example, but other supports in the conveyance system 100 are possible. It should be understood that while a derrick 101 is described herein, a derrick 101 may be appropriate for a WL conveyance, while other support systems may be used for other conveyance lines, such as an injection head for a CT line. The conveyance line 103 may be suspended, inserted into, or otherwise positioned within the wellbore 102. For instance, the conveyance line 103 may pass through a wellhead 108. The wellhead 108 may provide a structural, pressure, and/or fluid barrier between the wellbore and the surface 106. For instance, the wellhead 108 may contain wellbore fluids within the wellbore 102. In some embodiments, surface equipment of the conveyance system 100 includes an injector head for conveying the conveyance line 103 within the wellbore. For example, an injector head may include one or more (e.g., hydraulic) drives, chain assemblies, grip assemblies, or other components for providing a tractive effort for running and/or retrieving the conveyance line 103 into and/or from the wellbore 102.

The wellbore 102 may extend through a subsurface and may traverse various formations, layers, strata, or other subterranean features. The wellbore 102 may be a completed (e.g., fully drilled or fully formed) wellbore, or may be a wellbore at any intermediate stage of completion and/or drilling. The wellbore 102 is depicted as extending substantially straight or vertical into the ground, however, the wellbore 102 may be formed in accordance with any trajectory. For example, the wellbore 102 can include one or more bends, doglegs, inclinations, etc., such that the wellbore 102 may exhibit any level of deviation or tortuosity, including in 3-dimensional space.

The conveyance line 103 is connected to a downhole tool 104 for supporting or positioning the downhole tool 104 in the wellbore 102. The downhole tool 104 may be a logging tool, a completion tool, a production tool, or any other tool used for performing any downhole operation, such as for imaging or otherwise measuring characteristics of the wellbore 102 or subsurface, performing a perforation, setting a plug, retrieving lost or stuck equipment, isolating wellbore sections, testing wellbore integrity, sampling fluids, wellbore cleaning, wellbore repair, opening or closing valves, stimulation (e.g., fracking), circulating fluid, downhole communication, or any other tool for performing any other downhole function. In at least one embodiment according to the present disclosure, the downhole tool 104 includes an inflatable packer for isolating a wellbore section and a mud pump for inflating the inflatable packer, as will be described in more detail below.

The conveyance line 103 is contained on a spool, reel, or drum 105 which is typically mounted to a truck, trailer, skid, or other equipment. The conveyance line 103 and the downhole tool 104 are advanced into and out of the wellbore 102 from the drum 105 through a series of pulleys, sheaves, motors, and drives. For example, the derrick 101 may include one or more sheaves 107 for directing the conveyance line 103 from the drum into the wellbore 102. The derrick 101 may represent an integration of the conveyance system 100 with an existing drill rig (e.g., used for forming the wellbore) or may be implemented as a separate derrick, mast, rig or other surface equipment constructed for administering the conveyance line 103 into the wellbore.

The conveyance line 103, the downhole tool 104, and other components of the conveyance system 100 may be subject to various forces, loads, and other dynamics. These various components have failure limits and other operational thresholds at which the components may break, yield, or otherwise fail. In at least some embodiments, the inflation of the inflatable packer in the downhole tool 104 is controlled to limit strain on the conveyance line 103 to below a failure point.

The conveyance system 100 may include or may be associated with a client device 112 with a conveyance control system 120 implemented thereon (e.g., or with a client application implemented thereon for accessing the conveyance control system 120 as described herein). The conveyance control system 120 may facilitate identifying working thresholds for conveying the conveyance line 103 within the wellbore 102, as well as operating the conveyance control system 120 (e.g., inflation of the downhole tool 104) within those thresholds.

In some embodiments, an inflatable packer of the downhole tool is inflated or otherwise expanded radially outward toward the wellbore walls to limit and/or prevent fluid flow in the wellbore. For example, the inflatable packer may create a fluid seal against the wellbore wall that limits and/or prevents flow of fluid in the uphole direction in the wellbore. In some examples, the inflatable packer may create a fluid seal against the wellbore wall that limits and/or prevents flow of fluid in the downhole direction in the wellbore. In some examples, the inflatable packer may create a fluid seal against the wellbore wall that limits and/or prevents flow of a liquid wellbore fluid across the inflatable packer. In some examples, the inflatable packer may create a fluid seal against the wellbore wall that limits and/or prevents flow of a gaseous wellbore fluid across the inflatable packer.

Figure 2:
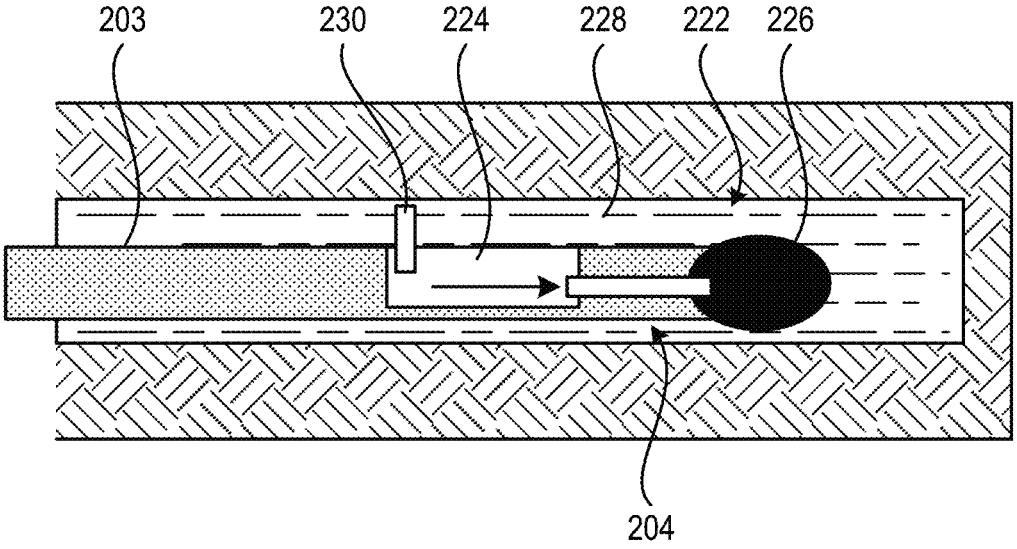
FIG. 2 is a schematic illustration of a downhole tool located proximate to a terminal end of a coiled tubing (CT) line, according to at least one embodiment of the present disclosure.

FIG. 2 is a schematic illustration of an embodiment of a downhole tool 204 located at or proximate to a terminal end 222 (e.g., downhole end) of a coiled tubing (CT) line 203 (i.e., conveyance line 103 described in relation to FIG. 1). In some embodiments, the downhole tool 204 includes a mud pump 224 and an inflatable packer 226 configured to be inflated at least in a radially outward direction. For example, the radially outward direction is radially outward relative to a longitudinal axis of the downhole tool 204, the inflatable packer 226, the CT line 203, or any combination thereof. In some embodiments, the mud pump 224 and the inflatable packer 226 are parts of a single downhole tool 204. In some embodiments, the mud pump 224 and the inflatable packer 226 are discrete downhole tools 204 of the CT system. For example, inflatable packer 226 may be selectively disconnected from the mud pump 224 to leave the inflatable packer 226 in place in the downhole environment once secured in the wellbore.

In a conventional CT system, an inflatable packer may be inflated by a flow of hydraulic fluid or drilling fluid delivered by the CT line 203 to the inflatable packer 226. The pressure differential and/or flow volume of the hydraulic fluid into the inflatable packer 226 inflates the inflatable packer 226 in a single operation. Such inflation has limited control (either in the downhole environment or from a surface control), and such inflation can result in damage to the CT line 203, the downhole tool 204, and/or the inflatable packer 226 through uncontrolled inflation against the wellbore wall, over-pressurization in the inflatable packer 226, or cross-flow of wellbore fluid during inflation.

In some embodiments according to the present disclosure, a downhole tool 204 inflates the inflatable packer 226 with the mud pump 224 in a controlled manner. For example, the mud pump 224 may have an adjustable pump rate that allows an adjustable inflation rate of the inflatable packer 226. In some embodiments, the mud pump 224 can be stopped or vented (e.g., an inflation fluid may be directed out of the downhole tool 204 without entering the inflatable packer 226) during inflation to pause inflation and/or allow deflation of the inflatable packer 226 if adverse conditions are detected. In some embodiments, the mud pump 224, therefore, allows more accurate and more precise control of a volume and/or fluid pressure of the inflatable packer 226 relative to conventional inflation methods.

In some embodiments, the mud pump 224 is a centrifugal pump. For example, a centrifugal pump may be effective for pumping lower-viscosity fluids, such as a water-based mud. In some embodiments, the mud pump 224 is a turbine pump. In some embodiments, the mud pump 224 is a displacement pump. For example, a displacement pump may be more effective for pumping higher-viscosity fluids, such as an oil-based mud. In some examples, the displacement pump is a positive displacement pump. In some examples, the displacement pump is a progressive displacement pump. In some examples, a centrifugal pump may have a higher flowrate, allowing a more rapid inflation of the inflatable packer 226. In some examples, a displacement pump may provide higher fluid pressure into the inflatable packer 226 to inflate the inflatable packer 226 in environments with higher wellbore pressure and/or in a more controlled manner.

In some embodiments, the mud pump 224 pumps an inflation fluid into the inflatable packer 226 to inflate the inflatable packer 226 in the downhole environment. In some embodiments, the inflation fluid is a wellbore fluid 228 that is received through an inlet to the mud pump 224 in fluid communication with an external port 230 into the wellbore. In some embodiments, the external port 230 draws in liquid wellbore fluid and directs the liquid wellbore fluid into the inflatable packer 226 to overcome a wellbore pressure and inflate the inflatable packer 226. In some embodiments, the wellbore fluid 228 includes formation fluid. In some embodiments, the wellbore fluid 228 includes drilling mud.

Figure 3:
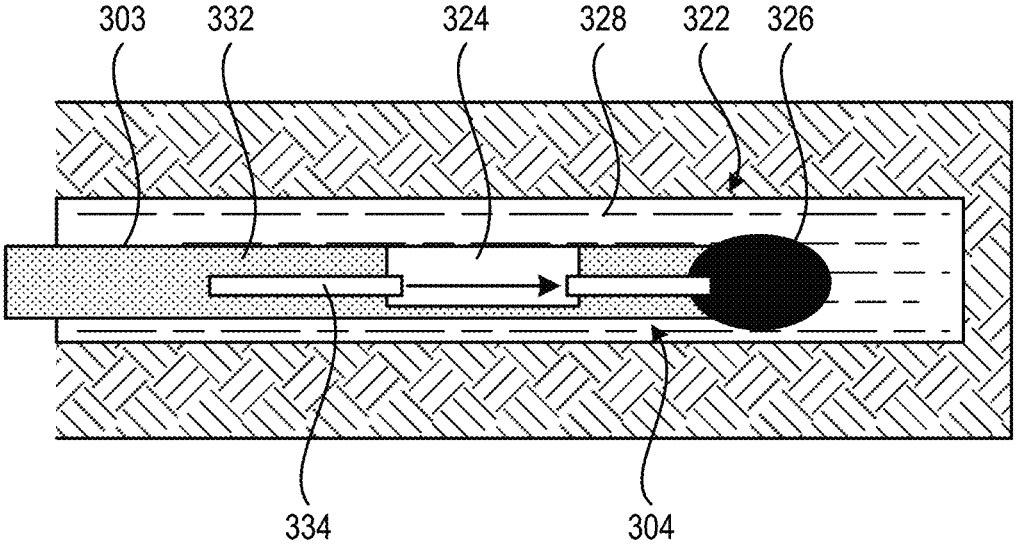
FIG. 3 is a schematic illustration of a downhole tool with an external port, according to at least one embodiment of the present disclosure.

In other embodiments, the mud pump is configured to receive a hydraulic fluid through the CT line. FIG. 3 is a schematic illustration of an embodiment of a downhole tool 304 at or near a terminal end 322 of a CT line 303. In some embodiments, the CT line 303 flows a CT fluid 332 from a surface source (such as the derrick described in relation to FIG. 1) to the downhole tool 304. The mud pump 324 receives the CT fluid 332 through an internal port 334 in fluid communication with the CT fluid 332. In some embodiments, the CT fluid 332 is a hydraulic fluid. In some embodiments, the CT fluid 332 is a drilling mud. In some embodiments, the CT fluid 332 is a clean fluid. A clean fluid may be beneficial in downhole environments in which the wellbore fluid 328 may damage the mud pump 324 and/or inflatable packer 326. For example, a wellbore fluid 328 may include cuttings, swarf, or other solid particles that may damage seals of the mud pump 324 and/or flexible materials of the inflatable packer 326.

Figure 4:
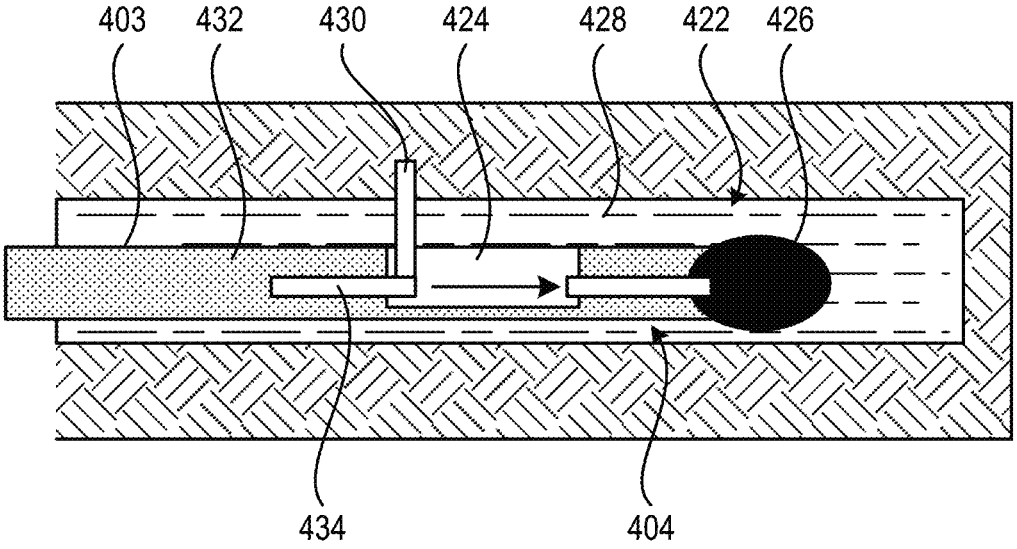
FIG. 4 is a schematic view of a downhole tool with an internal port, according to at least one embodiment of the present disclosure.

FIG. 4 is a schematic view of another embodiment of a downhole tool 404 at or near a terminal end 422 of a CT line 403. In some embodiments, the CT line 403 flows a CT fluid 432 from a surface source (such as the derrick described in relation to FIG. 1) to the downhole tool 404. In some embodiments, the mud pump 424 receives the CT fluid 432 through an internal port 434 in fluid communication with the CT fluid 432. In some embodiments, the mud pump 424 also receives wellbore fluid 428 from an external port 430. The mud pump 424 may, therefore, pump an inflation fluid including both a CT fluid 432 and wellbore fluid 428.

In some embodiments, the mud pump 424 is configured to exhaust inflation fluid through the external port 430 to the wellbore. For example, the mud pump 424 may operate in reverse to remove inflation fluid from the inflatable packer 426 to deflate the inflatable packer 426 through the external port 430. In some embodiments, a wellbore pressure on the inflatable packer 426 may exceed a safe limit, and the external port 430 may vent pressure from the inflatable packer 426.

Figure 5:
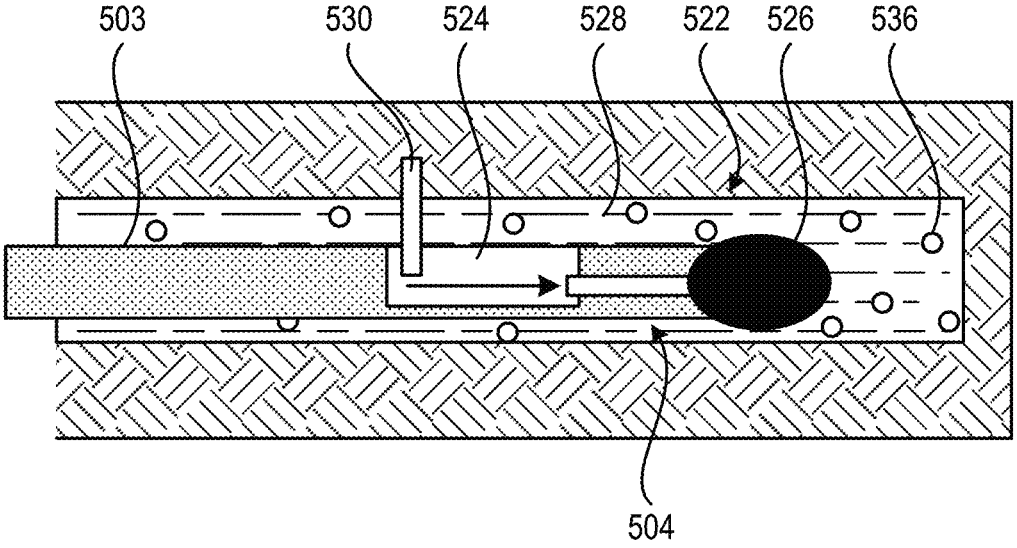
FIG. 5 is a schematic view of a downhole tool with both an internal port and an external port, according to at least one embodiment of the present disclosure.

FIG. 5 is a schematic view of another embodiment of a downhole tool 504 at or near a terminal end 522 of a CT line 503. In some embodiments, the mud pump 524 is configured to pump gas into the inflatable packer 526. For example, the mud pump 524 may receive gaseous formation fluid 536 from an external port 530. In some embodiments, the gaseous formation fluid 536 is in the wellbore. In some embodiments, the gaseous formation fluid 536 is extracted from the wellbore fluid 528. In some embodiments, the downhole tool 504 is located in a dry wellbore with no liquid wellbore fluid therein. In such examples, the mud pump 524 may be configured to pump gaseous formation fluid 536 and/or air from the wellbore into the inflatable packer 526.

Figure 6:
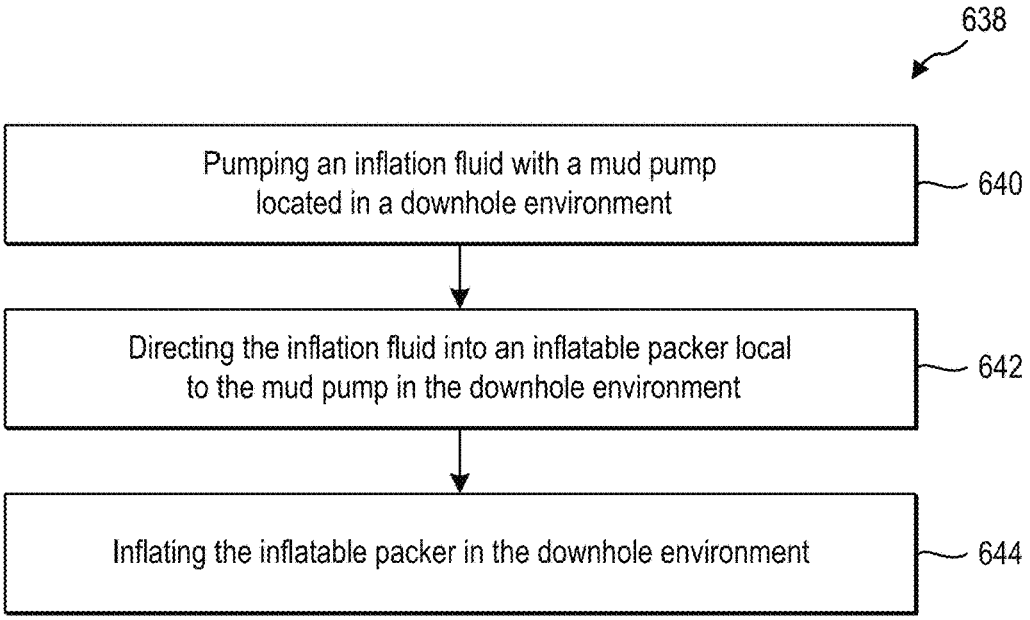
FIG. 6 is a flowchart illustrating a method of controlling a downhole tool, according to at least one embodiment of the present disclosure.

FIG. 6 is a flowchart illustrating an embodiment of a method 638 of controlling a downhole tool. In some embodiments, the method 638 includes pumping an inflation fluid with a mud pump located in a downhole environment at 640. In some embodiments, the inflation fluid includes wellbore fluid. In some embodiments, the inflation fluid includes formation fluid. In some embodiments, the inflation fluid includes drilling fluid. In some embodiments, the inflation fluid includes a CT fluid. In some embodiments, the inflation fluid includes a liquid fluid. In some embodiments, the inflation fluid includes a gaseous fluid. In some embodiments, the mud pump is a centrifugal pump. In some embodiments, the mud pump is a turbine pump. In some embodiments, the mud pump is a displacement pump.

The method 638 further includes directing the inflation fluid into an inflatable packer local to the mud pump in the downhole environment at 642. For example, the mud pump and the inflatable packer may be located in the same downhole tool. In other examples, the mud pump may be coupled to the inflatable packer. The inflatable packer is in fluid communication with the mud pump to receive the inflation fluid from the mud pump. In some embodiments, the inflatable packer is directly connected to an outlet of the mud pump. In some embodiments, an outlet of the mud pump is connected to a pipe, tube, or other conduit that flows the inflation fluid to the inflatable packer.

In some embodiments, the inflatable packer is inflated by the mud pump with a relative pressure over the wellbore pressure. In some embodiments, the inflatable packer is inflated with a relative pressure over the wellbore pressure greater than 1,000 pounds per square inch (psi). In some embodiments, the inflatable packer is inflated with a relative pressure over the wellbore pressure greater than 5,000 psi. In some embodiments, the inflatable packer is inflated with a relative pressure over the wellbore pressure greater than 10,000 psi.

The method 638, in some embodiments, further includes inflating the inflatable packer in the downhole environment at 644. In some embodiments, the method includes fully inflating the inflatable packer against the wellbore walls to isolate a portion of the wellbore. In some embodiments, the method includes partially inflating the inflatable packer toward the wellbore walls, as the more precise inflation of the packer allows for controlled inflation, in contrast to conventional inflation methods. For example, the method may include partially inflating the inflatable packer and measuring a cross-flow of wellbore fluid across the packer.

Figure 7:
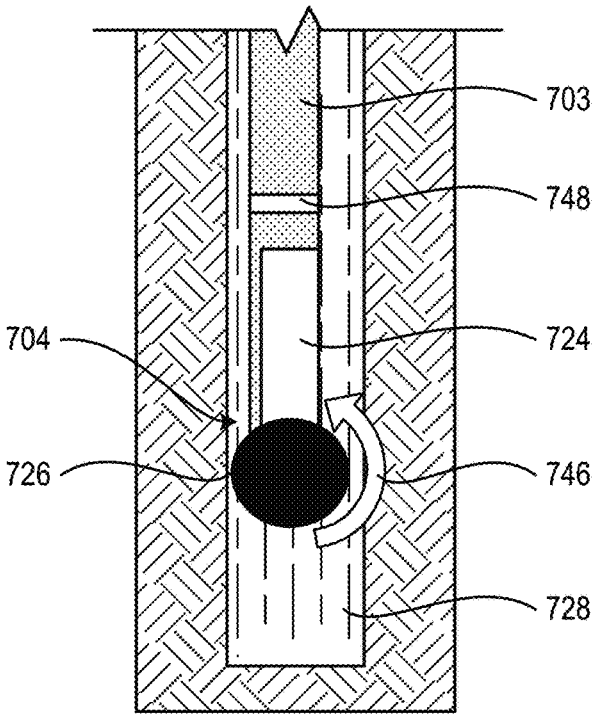
FIG. 7 is a cross-sectional view of a downhole tool configured to measure cross-flow, according to at least one embodiment of the present disclosure.

FIG. 7 is a cross-sectional view of an embodiment of a downhole tool 704 conveyed by a CT line 703 into a downhole environment. In some embodiments, a mud pump 724 directs an inflation fluid into the inflatable packer 726 to partially inflate the inflatable packer 726. Wellbore fluid 728 may flow between the inflatable packer 726 and the wellbore wall during inflation or after partial inflation of the inflatable packer 726. In some embodiments, the cross-flow 746 across packer 726 may damage the inflatable packer 726, such as when the cross-flow 746 is of sufficiently high velocity and/or when the cross-flow 746 carries solid particles past the inflatable packer 726. Force applied to the inflatable packer 726 by the cross-flow 746 may damage the inflatable packer 726, but the inflatable packer 726 may be selectively deflated (as described herein) to limit and/or prevent damage.

In some embodiments, the cross-flow 746 occurs substantially evenly around the inflatable packer 726. In some embodiments, the cross-flow 746 occurs on a single side of the inflatable packer 726, which may further force the inflatable packer 726 and/or the downhole tool 704 to strike a wellbore wall. In some embodiments, the downhole tool 704 and/or CT line 703 includes one or more sensors that may measure at least one property of the cross-flow 746. In some embodiments, a strain gauge 748 is located in the downhole tool 704 and/or in the CT line 703 above the downhole tool 704. A strain gauge 748 may measure a force applied to the inflatable packer 726 by the cross-flow 746. In some embodiments, a velocity of the cross-flow 746 may be calculated from the measurement(s) of the strain gauge 748. In some embodiments, the strain gauge 748 (or a plurality of strain gauges) may measure a balance of the cross-flow 746, such as by measuring different force on different sides of the downhole tool 704 and/or CT line 703. The balance of the cross-flow 746 may indicate a torque applied to the inflatable packer 726 and/or downhole tool 704 during inflation of the inflatable packer 726.

In some embodiments, a pressure sensor in or in fluid communication with the inflatable packer 726 may measure changes in the wellbore pressure and/or wellbore flow. For example, an unstable flow from the formation may cause changes to the wellbore pressure and flow of wellbore fluid. A pressure sensor in or in fluid communication with the inflatable packer 726 may allow an operator or a control system to determine a safe inflation rate or inflation timing for the inflatable packer 726 by control of the mud pump 724.

In some embodiments, the strain gauge, pressure sensor, or other sensors are in data communication with a surface location, such as the control system 120 described in relation to FIG. 1. The sensors may report wellbore pressure, cross-flow information, and force(s) applied to the inflatable packer and/or the downhole tool, and the inflation of the inflatable packer may be adjusted through adjusting a control of the mud pump based on the cross-flow to limit and/or prevent damage to the inflatable packer. In at least some embodiments, the more precise inflation control provided by a downhole mud pump according to the present disclosure may allow controlled and safe inflation of an inflatable packer with less risk of damage to the CT system than a conventional pressure differential packer inflation method.

The embodiments of the packer inflation system have been primarily described with reference to wellbore operations; the packer inflation system described herein may be used in applications other than those of a wellbore. In other embodiments, the packer inflation system according to the present disclosure may be used outside a wellbore or other downhole environment used for the exploration or production of natural resources. For instance, the packer inflation system of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

Embodiments of the present disclosure relate to systems and methods for controlling a downhole tool in a downhole environment according to at least the following clauses:

Clause 1. A method of controlling a downhole tool of a coiled tubing system, the method comprising: pumping an inflation fluid with a mud pump located in a downhole environment; directing the inflation fluid into an inflatable packer local to the mud pump in the downhole environment; and inflating the inflatable packer in the downhole environment.

Clause 2. The method of clause 1, further comprising conveying a coiled tubing line into the downhole environment, wherein the mud pump and inflatable packer are located at a downhole end of the coiled tubing line.

Clause 3. The method of clause 1, wherein the mud pump is a centrifugal pump.

Clause 4. The method of clause 1, wherein the mud pump is a displacement pump.

Clause 5. The method of clause 1, wherein the inflation fluid is a liquid.

Clause 6. The method of clause 1, wherein the inflation fluid is a gas.

Clause 7. The method of clause 1, wherein the inflation fluid is a wellbore fluid external to a coiled tubing line.

Clause 8. The method of clause 1, wherein the inflation fluid is a coiled tubing fluid flowing through a coiled tubing line from a surface source.

Clause 9. The method of clause 1, wherein the inflation fluid includes both a coiled tubing fluid flowing through a coiled tubing line from a surface source and a wellbore fluid external to the coiled tubing line.

Clause 10. The method of clause 1, wherein the mud pump draws fluid from both a coiled tubing line and a wellbore in the downhole environment.

Clause 11. The method of clause 1, further comprising measuring a cross-flow of wellbore fluid across the inflatable packer in the downhole environment while inflating the inflatable packer.

Clause 12. The method of clause 11, wherein measuring the cross-flow includes measuring a strain on a strain gauge proximate to the inflatable packer.

Clause 13. The method of clause 11, wherein measuring the cross-flow includes measuring a fluid pressure on the inflatable packer.

Clause 14. A method of controlling a downhole tool, the method comprising: pumping an inflation fluid with a mud pump located in a downhole environment; directing the inflation fluid into an inflatable packer local to the mud pump in the downhole environment; partially inflating the inflatable packer in the downhole environment; measuring a cross-flow of wellbore fluid proximate to the inflatable packer; and adjusting a control of the mud pump based on the cross-flow.

Clause 15. The method of clause 14, wherein adjusting a control of the mud pump based on the cross-flow includes deflating the inflatable packer with the mud pump.

Clause 16. The method of clause 15, wherein deflating the inflatable packer with the mud pump includes venting inflation fluid through an external port.

Clause 17. A system, comprising: a derrick; a coiled tubing line partially positioned within a wellbore and being conveyed from a drum; a mud motor located at a terminal end of the coiled tubing line; and an inflatable packer in fluid communication with the mud motor and configured to receive an inflation fluid from the mud motor.

Clause 18. The system of clause 17, wherein the mud motor is configured to receive wellbore fluid through an external port.

Clause 19. The system of clause 17, wherein the mud motor is configured to receive a coiled tubing fluid from the coiled tubing line.

Clause 20. The system of clause 17, further comprising a strain gauge in the coiled tubing line.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements. Additionally, as used herein, the term "and/or" includes any and all combinations of one or more of the associated listed items.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method of controlling a downhole system of a coiled tubing system, the method comprising:

pumping an inflation fluid with a mud pump located in a downhole environment, wherein the inflation fluid includes:

a clean coiled tubing fluid flowing through a coiled tubing line from a surface source; and a wellbore fluid external to the coiled tubing line;

directing the inflation fluid into an inflatable packer local to the mud pump in the downhole environment; and inflating the inflatable packer in the downhole environment.

2. The method of claim 1, further comprising conveying the coiled tubing line into the downhole environment, wherein the mud pump and the inflatable packer are located at a downhole end of the coiled tubing line.

3. The method of claim 1, wherein the mud pump is a centrifugal pump.

4. The method of claim 1, wherein the mud pump is a displacement pump.

5. The method of claim 1, wherein the inflation fluid is a liquid.

6. The method of claim 1, further comprising deflating the inflatable packer by reversing the mud pump to remove the inflation fluid through an external port.

7. The method of claim 1, wherein the mud pump draws fluid from both the coiled tubing line and a wellbore in the downhole environment.

8. The method of claim 1, further comprising measuring a cross-flow of wellbore fluid across the inflatable packer in the downhole environment while inflating the inflatable packer.

9. The method of claim 8, wherein measuring the cross-flow includes measuring a strain on a strain gauge proximate to the inflatable packer.

10. The method of claim 8, wherein measuring the cross-flow includes measuring a fluid pressure on the inflatable packer.

11. The method of claim 1, further comprising deflating the inflatable packer by venting the inflation fluid through an external port.

12. A method of controlling a downhole system of a coiled tubing system, the method comprising:

pumping an inflation fluid with a mud pump located in a downhole environment, wherein the inflation fluid includes a clean coiled tubing fluid flowing through a coiled tubing line from a surface source;

directing the inflation fluid into an inflatable packer local to the mud pump in the downhole environment;

inflating the inflatable packer in the downhole environment; and deflating the inflatable packer by reversing the mud pump to remove the inflation fluid through an external port.

13. The method of claim 12, wherein the mud pump is a centrifugal pump.

14. The method of claim 12, further comprising measuring a cross-flow of wellbore fluid across the inflatable packer in the downhole environment while inflating the inflatable packer.

15. The method of claim 14, wherein measuring the cross-flow includes measuring a strain on a strain gauge proximate to the inflatable packer.

16. The method of claim 14, wherein measuring the cross-flow includes measuring a fluid pressure on the inflatable packer.

17. A method of controlling a downhole system of a coiled tubing system, the method comprising:

pumping an inflation fluid with a mud pump located in a downhole environment, wherein the inflation fluid includes a clean coiled tubing fluid flowing through a coiled tubing line from a surface source, and wherein the mud pump draws fluid from both the coiled tubing line and a wellbore in the downhole environment;

directing the inflation fluid into an inflatable packer local to the mud pump in the downhole environment; and inflating the inflatable packer in the downhole environment.

18. The method of claim 17, further comprising measuring a cross-flow of wellbore fluid across the inflatable packer in the downhole environment while inflating the inflatable packer.

19. The method of claim 18, wherein measuring the cross-flow includes measuring a strain on a strain gauge proximate to the inflatable packer.

20. The method of claim 18, wherein measuring the cross-flow includes measuring a fluid pressure on the inflatable packer.

* * * * *